US009624730B2

(12) United States Patent
Runquist et al.

(10) Patent No.: US 9,624,730 B2
(45) Date of Patent: Apr. 18, 2017

(54) HARD FACING CONFIGURATION FOR A DRILLING TOOL

(75) Inventors: Randy R. Runquist, Knoxville, IA (US); Keith Allen Hoelting, Dallas, IA (US); Chris Fontana, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 930 days.

(21) Appl. No.: 13/991,090

(22) PCT Filed: Nov. 30, 2011

(86) PCT No.: PCT/US2011/062634
§ 371 (c)(1),
(2), (4) Date: May 31, 2013

(87) PCT Pub. No.: WO2012/075134
PCT Pub. Date: Jun. 7, 2012

(65) Prior Publication Data

US 2013/0248255 A1 Sep. 26, 2013

Related U.S. Application Data

(60) Provisional application No. 61/418,772, filed on Dec. 1, 2010.

(51) Int. Cl.

| | |
|---|---|
| ***E21B 10/08*** | (2006.01) |
| ***E21B 10/54*** | (2006.01) |
| ***E21B 10/62*** | (2006.01) |
| ***B05D 1/32*** | (2006.01) |

(52) U.S. Cl.
CPC ..... *E21B 10/08* (2013.01); *B05D 1/32* (2013.01); *E21B 10/54* (2013.01); *E21B 10/62* (2013.01)

(58) Field of Classification Search
CPC ..... E21B 10/08; E21B 10/54; E21B 10/62; E21B 10/627; E21B 10/633; E21B 10/16; B05D 1/32
See application file for complete search history.

(56) References Cited

U.S. PATENT DOCUMENTS

| | | | | |
|---|---|---|---|---|
| 4,597,456 | A | 7/1986 | Ecer | |
| 4,762,028 | A | 8/1988 | Regan | |
| 4,941,538 | A * | 7/1990 | King | E21B 10/43 175/431 |
| 5,425,288 | A | 6/1995 | Evans | |
| 5,492,186 | A | 2/1996 | Overstreet et al. | |
| 6,102,140 | A | 8/2000 | Boyce et al. | |
| 6,196,338 | B1 | 3/2001 | Slaughter et al. | |
| 6,302,224 | B1 | 10/2001 | Sherwood, Jr. | |
| 6,390,087 | B1 | 5/2002 | Wentworth et al. | |
| 6,568,491 | B1 | 5/2003 | Matthews, III et al. | |

(Continued)

OTHER PUBLICATIONS

International Search Report for corresponding International Patent Application No. PCT/US2011/062634 mailed Jul. 16, 2012.

*Primary Examiner* — Blake Michener
*Assistant Examiner* — Wei Wang
(74) *Attorney, Agent, or Firm* — Merchant & Gould P.C.

(57) ABSTRACT

Bits configured for drilling rock that are of the type that includes a plurality of teeth supported in pockets that are on a cutting face that is driven to rotate. The pockets are configured to allow the teeth to passively rotate while in the pockets. The present disclosure provides a bit having hard-facing around the pockets and related methods.

16 Claims, 10 Drawing Sheets

(56) References Cited

U.S. PATENT DOCUMENTS

| | | | | |
|---|---|---|---|---|
| 6,601,475 | B2 | 8/2003 | Davies et al. | |
| 7,343,990 | B2 | 3/2008 | Pessier et al. | |
| 2008/0236900 | A1* | 10/2008 | Cooley ..... | E21B 10/5735 175/432 |
| 2010/0219001 | A1 | 9/2010 | Shen et al. | |

* cited by examiner

HARD FACING CONFIGURATION FOR A DRILLING TOOL

This application is a National Stage of PCT/US2011/062634, filed Nov. 30, 2011, which claims benefit of U.S. Provisional Patent Application Ser. No. 61/418,772, filed Dec. 1, 2010, and which applications are incorporated herein by reference. To the extent appropriate, a claim of priority is made to each of the above disclosed applications.

TECHNICAL FIELD

The present disclosure provides a drill bit with hardfacing in the vicinity of a rotary tooth located on a cutting face and a method of manufacturing the same.

SUMMARY

Bits configured for drilling rock that are of the type that includes a plurality of teeth supported in pockets that are on a cutting face that is driven to rotate. The pockets are configured to allow the teeth to passively rotate while the teeth are secure in the pockets. The present disclosure provides a bit having hardfacing in the vicinity of the pockets and related methods.

DETAILED DESCRIPTION

The present disclosure is directed to bits configured for drilling rock. The bit 10 includes a distal cutting end 12 and a proximal mounting end 14. The mounting end 14 is configured to mount to a component that drives rotation of the bit 10 (e.g., sonde housing, pilot/starter drill rod, drill rod, etc.) about its central axis AA.

Figure 6:
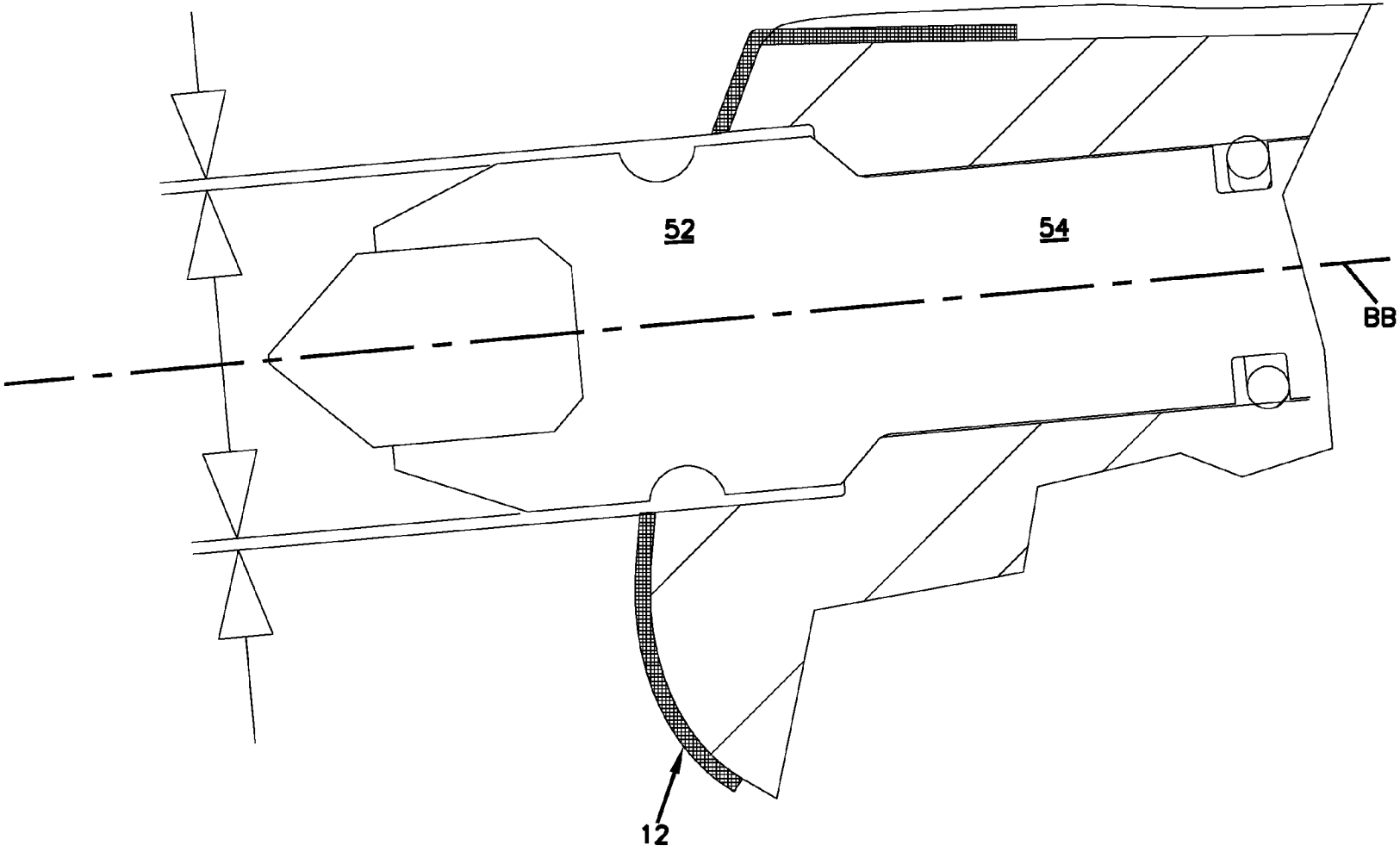
FIG. 6 is a partial cross-sectional view of the drill bit of FIG. 1 showing a tooth within the tooth pocket.
Figure 7:
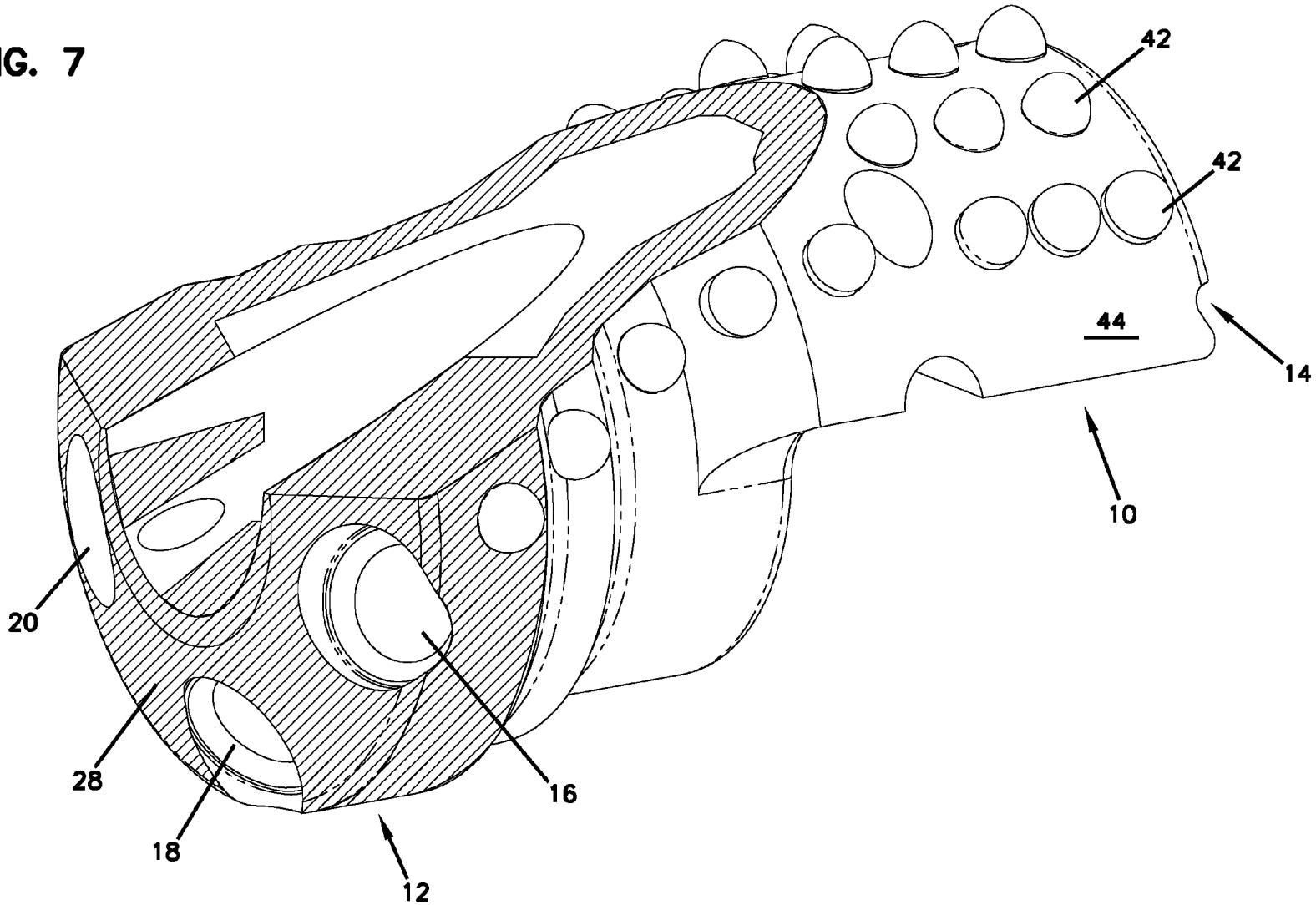
FIG. 7 is a perspective view of an alternative embodiment to the drill bit shown in FIG. 1.
Figure 8:
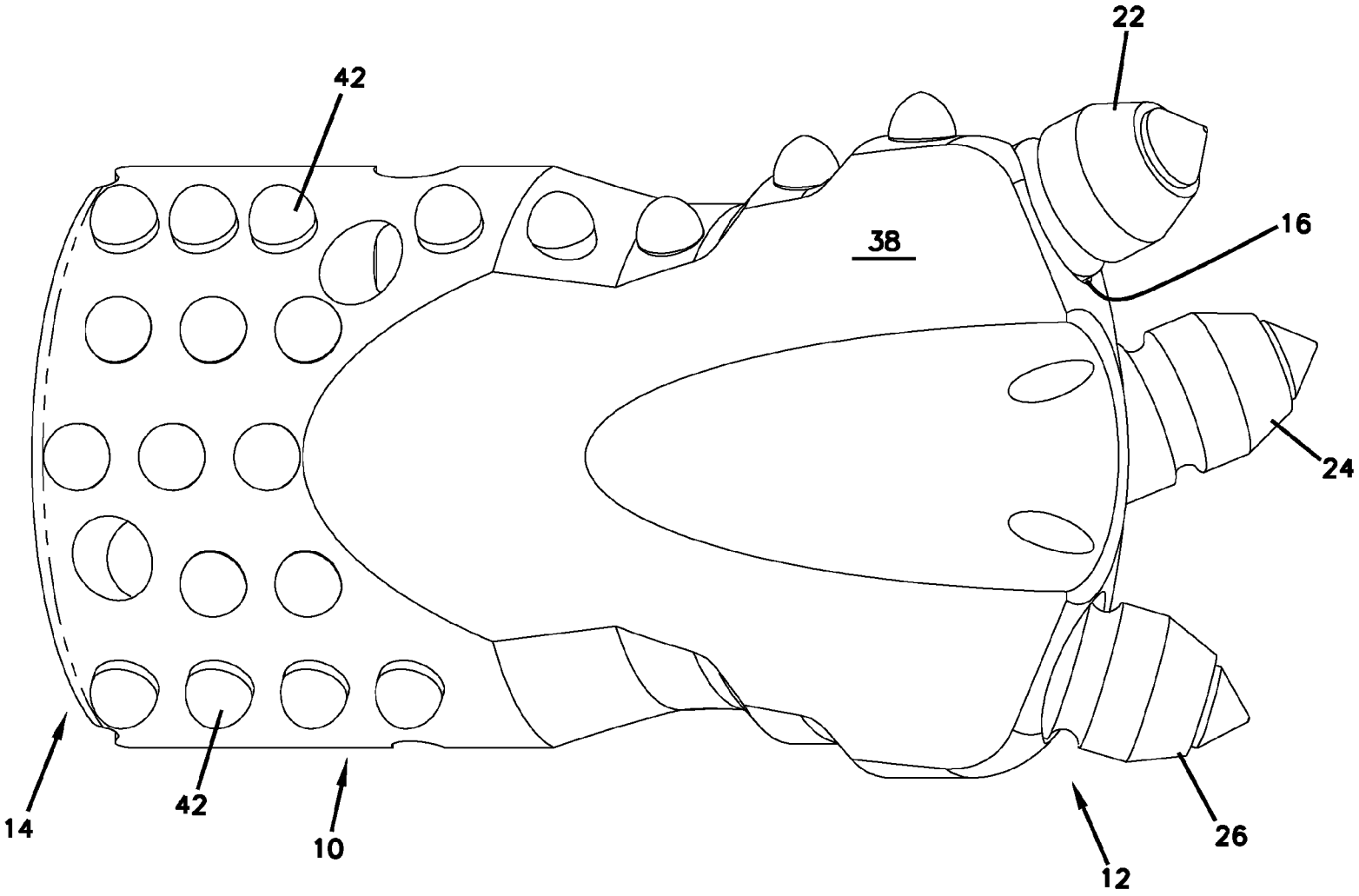
FIG. 8 is a side view of the drill bit of FIG. 1.

In the depicted embodiment, the distal cutting 12 end includes a plurality of pockets 16, 18, 20, each pocket configured to support a cutting tooth 22, 24, 26 such that the tooth is free to rotate passively about a longitudinal axis BB of the tooth (see FIG. 6). In other words, the teeth rotate about axis AA with the cutting end and are also free to rotate passively about axis BB relative to the cutting end. In the depicted embodiment, the distal cutting end 12 includes three pockets and three teeth. However, it should be appreciated that many other configurations are possible.

Figure 1:
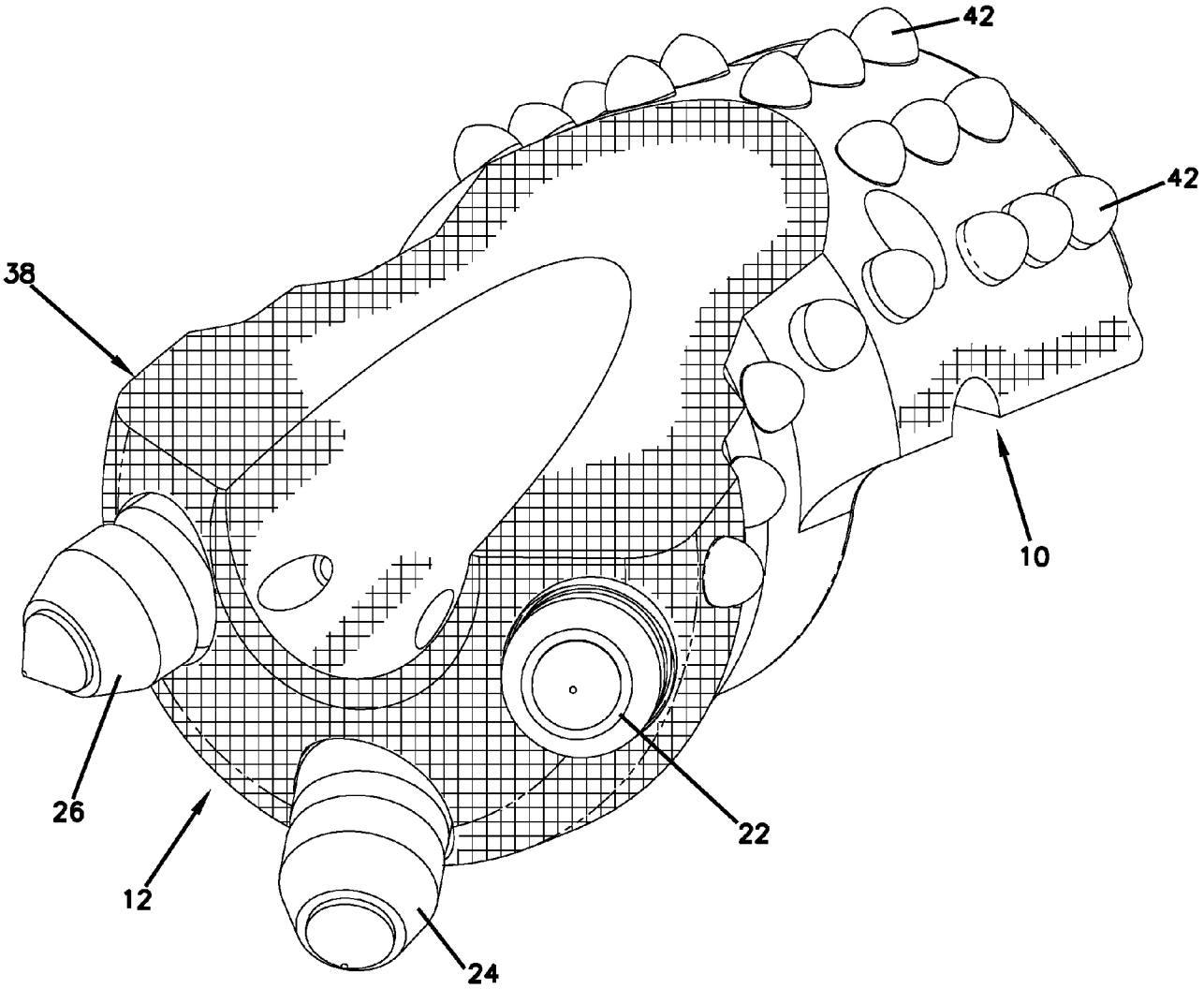
FIG. 1 is a perspective view of a drill bit according to the principles of the present disclosure.
Figure 2:
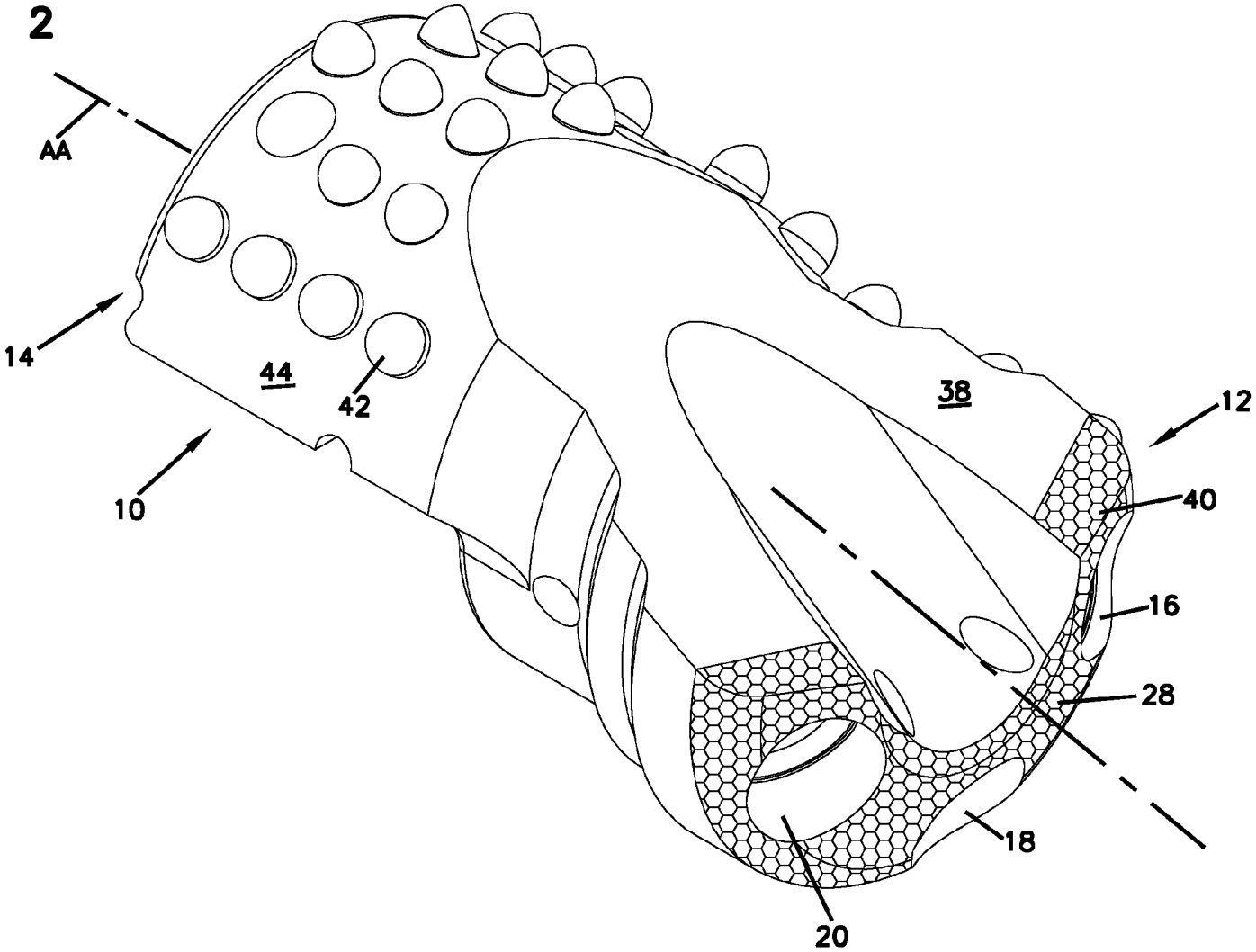
FIG. 2 is a perspective view of the drill bit of FIG. 1 with the rotatable teeth removed.
Figure 3:
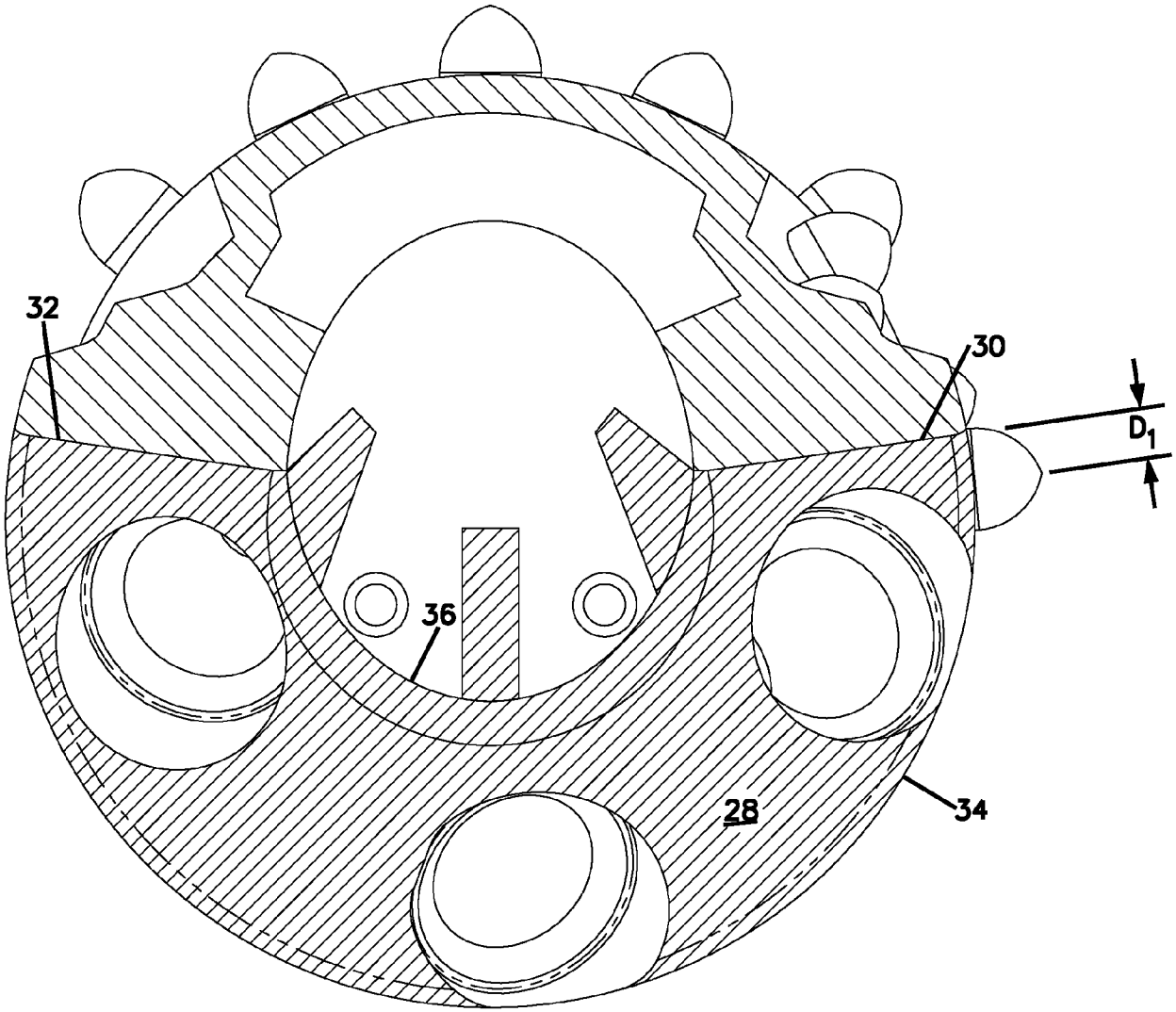
FIG. 3 is an end view of the drill bit of FIG. 1.
Figure 4:
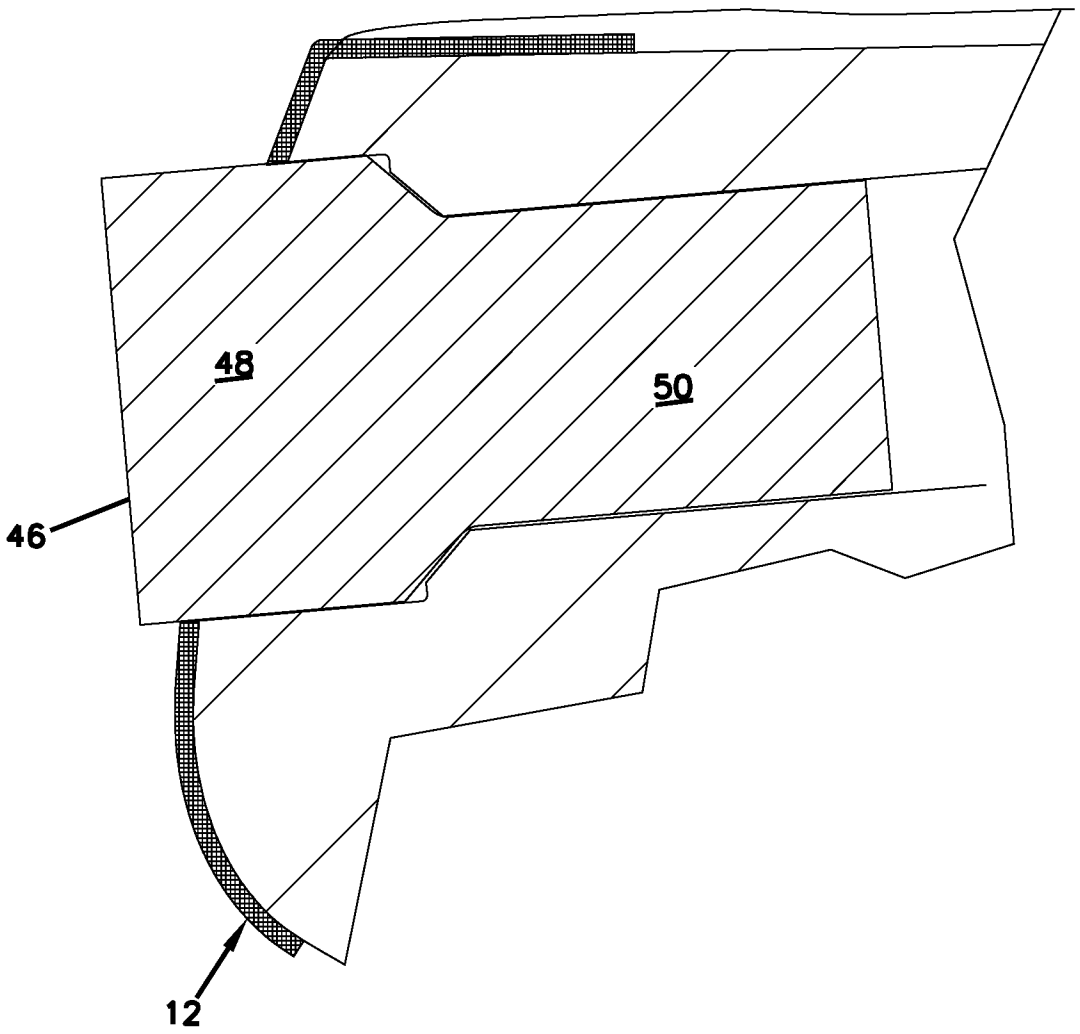
FIG. 4 is a partial cross-sectional view of the drill bit of FIG. 1 showing a plug within a tooth pocket.
Figure 5:
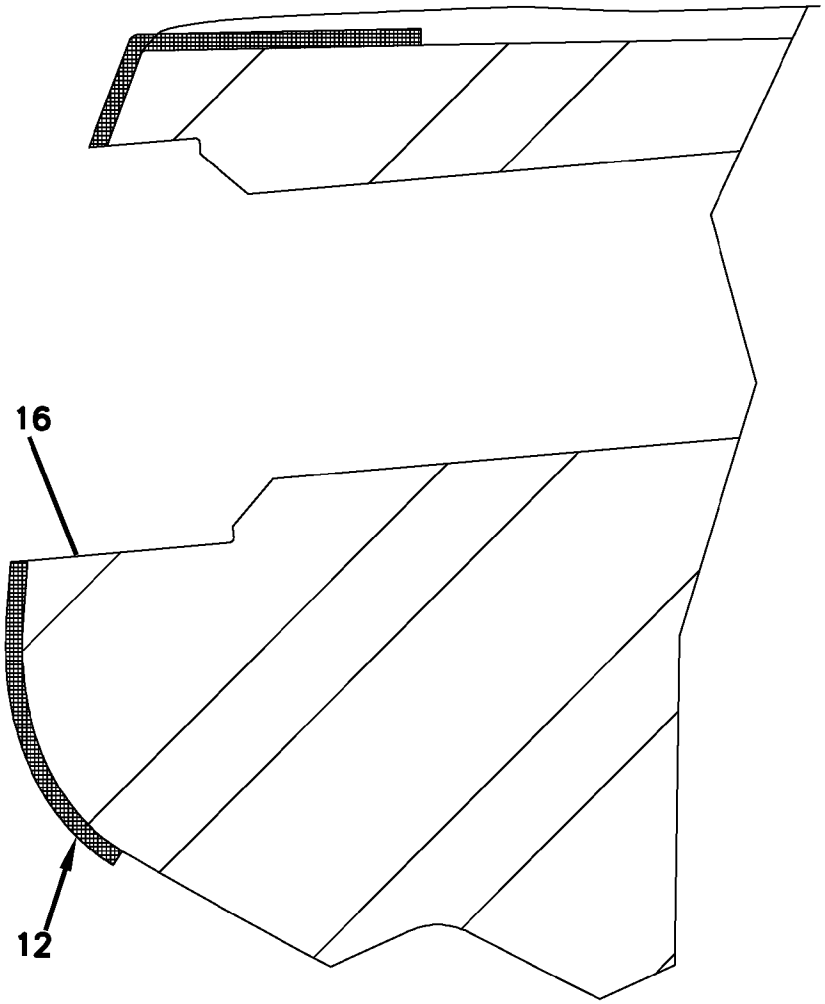
FIG. 5 is a partial cross-sectional view of the drill bit of FIG. 1 showing the plug removed from the tooth pocket.

In the depicted embodiment the distal cutting end 12 defines a cutting face 28 having hardfacing thereon (hexagon shapes illustrate hardfacing in FIGS. 1 and 2). In the depicted embodiment the cutting face 28 is a generally domed shaped partial ring having a periphery defined by straight lines 30, 32 and curved lines 34 and 36. However, it should be appreciated than many other cutting face configurations are also possible.

Figure 9:
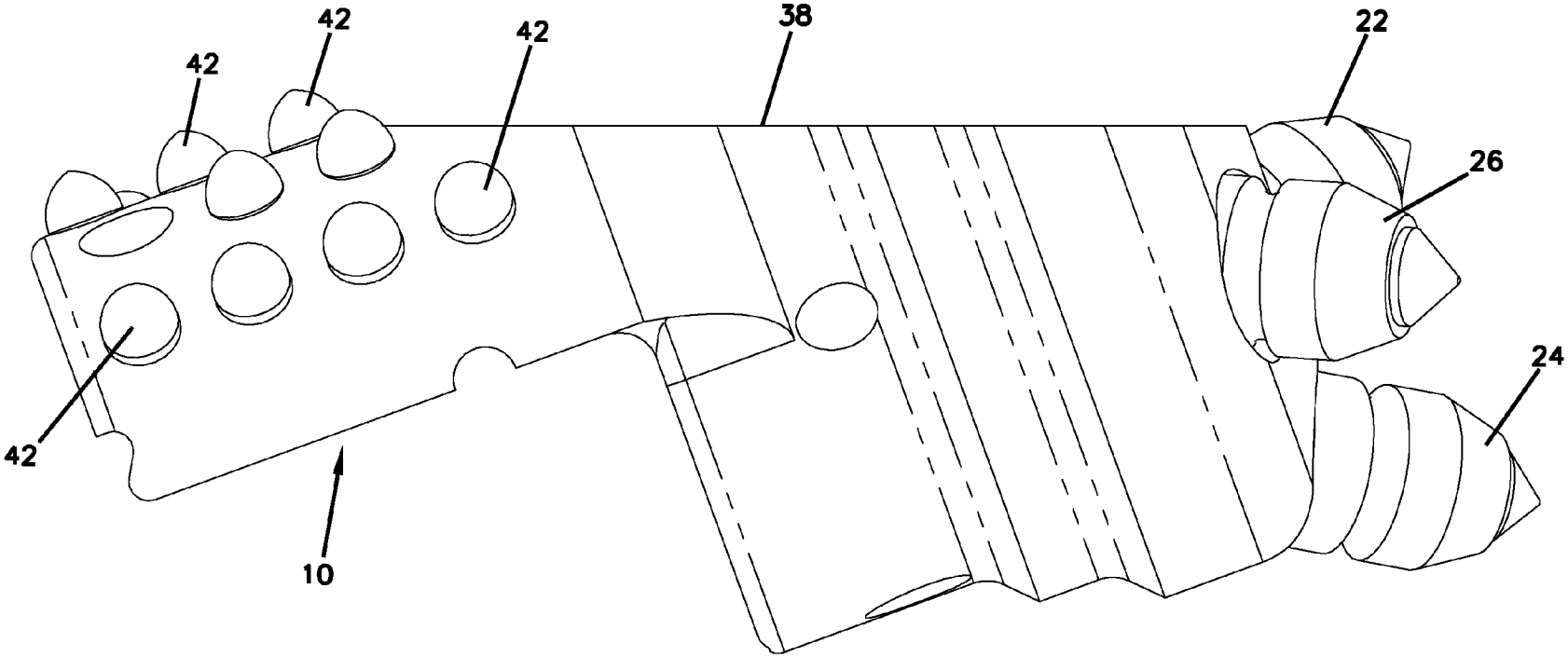
FIG. 9 is a side view of the drill bit of FIG. 1 at a different orientation than is shown in FIG. 8.
Figure 10:
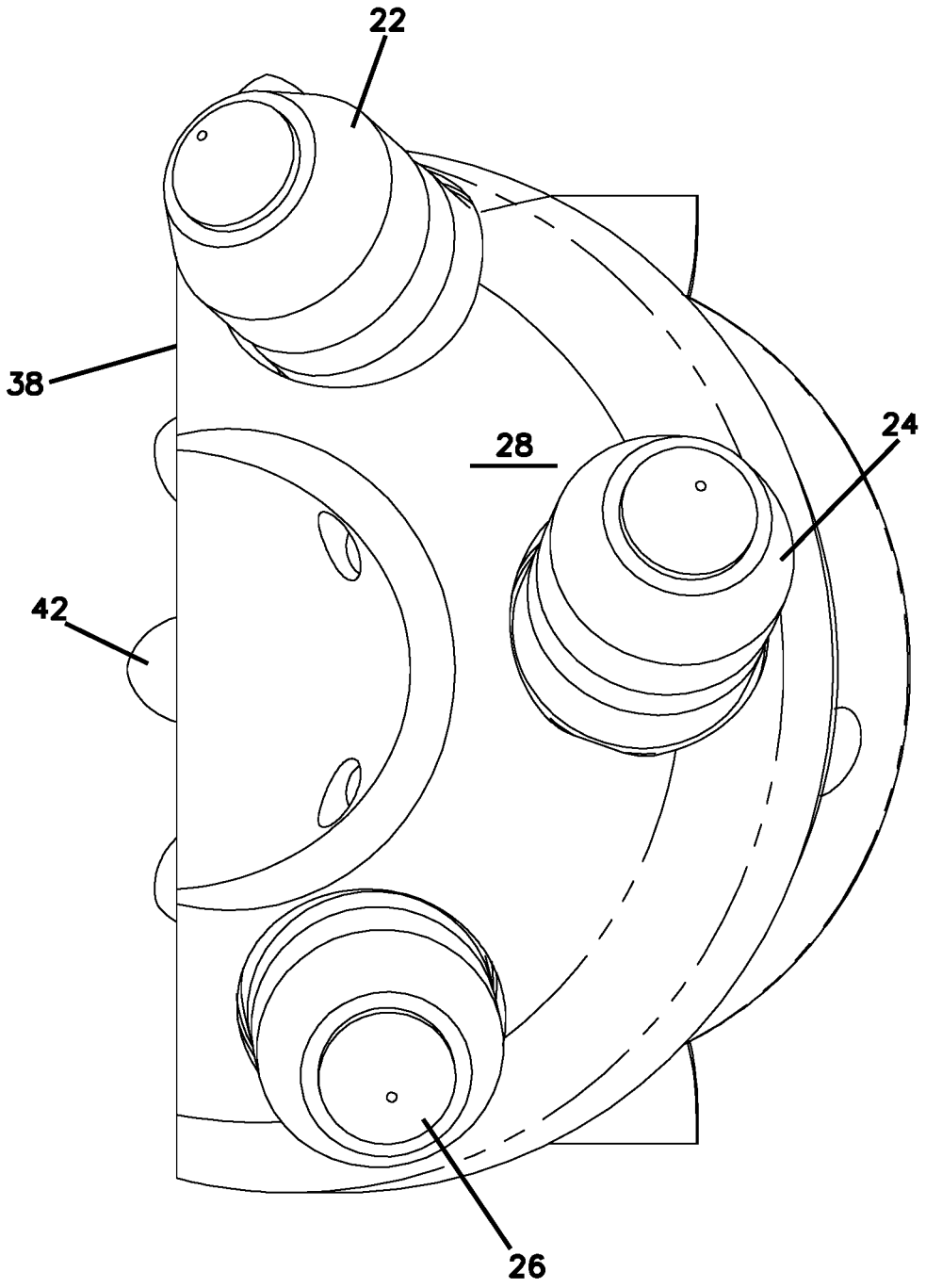
FIG. 10 is an end view of the drill bit of FIG. 1 oriented parallel to the angled surface on the drill bit.

In the depicted embodiment the bit 10 includes angled surface 38 that defines a leading edge 40 at a junction between the angled surface 38 and the distal cutting end 12. In the depicted embodiment the angled surface 38 extends radially outwardly towards the mounting end. In the depicted embodiment, the pocket 16 is a lead pocket when the drill string is rotated in a clockwise direction. The lead pocket 16 is configured to support a cutting tooth such that the tooth 22 extends past a plane defined by the angled surface 38 (FIGS. 9 and 10). In other words, the lead pocket 16 is arranged and configured such that a portion of the tooth 22 engages the drilling medium (e.g., rock) before other portions of the bit engage the drill medium. The depicted configuration provides a drill bit that drills effectively and is relatively easy to steer.

In a depicted embodiment the minimum distance between the leading edge 40 and a periphery edge of the lead pocket 16 is less than 0.5 inches (e.g., 0.33 of an inch). In a depicted embodiment the hardfacing is provided in the narrowest portion between the lead pocket 16 and the leading edge 40. It should be appreciated that many other configurations are also possible.

In the depicted embodiment, hardfacing is provided on substantially the entire cutting face 28 (e.g., at least seventy-five percent of the face, at least ninety percent of the cutting face, etc.). The hardfacing on the cutting face 28 avoids the need to also provide carbide buttons 42 thereon. In the depicted embodiment the carbide buttons 42 are provided around the side surface 44 of bit 10. However, it should be appreciated that in alternative embodiments, less of the cutting face 28 may be covered by hardfacing and/or carbide buttons 42 may also be provided on the cutting face 28.

In the depicted embodiment the hardfacing is provided near the edge of the pockets 16, 18, 20. In a depicted embodiment at least some of the hardfacing is provided within one-thirty second of an inch from a periphery edge of the pocket. For example, right up to the edge of the pocket (zero offset as shown in FIGS. 3, 4, 5 and 6; less than 1/32, less than 1/64 offset, etc.).

The present disclosure also provides a method of manufacturing a drill bit. The method includes the step of inserting plugs 46 into the plurality of pockets 16, 18, 20. The plugs facilitate the hardfacing process by preventing hardfacing material from entering the pockets, which could otherwise cause interference between the teeth 22, 24, 26 and the pockets 16, 18, 20 and hinder the passive rotation of the teeth while in the pocket.

In the depicted embodiment, the use of the plugs allows for hardfacing right up to and around the periphery edge of the pockets 16, 18, 20, which is also the edge of the plugs. In some embodiments hardfacing is provided around the entire periphery edge of the pocket by hardfacing right up to and around the entire periphery edge of the plug. In a depicted embodiment the plugs are snuggly fit into the pockets. For example, the plugs include a maximum cross-sectional dimension that is within one-sixteenth of an inch (1.59 millimeters) of a maximum cross-sectional dimension of the pockets. In a depicted embodiment the plugs includes a first cylindrical portion 48 and a second cylindrical portion 50, the first cylindrical portion 48 including a larger diameter than the second cylindrical portion 50. In the depicted embodiment the plugs include a brass exterior portion, which facilitates their removal from the pockets after the hardfacing.

In the depicted embodiment, the plugs are removed from the bit after the hardfacing process, and teeth are inserted into the plurality of pockets. The teeth include a larger cylindrical portion 52 and a smaller cylindrical portion 54. The diameter of the larger cylindrical portion of the plug is between one-sixteenth of an inch to one-thirty second of an inch greater than the diameter of the larger cylindrical portion of the teeth. In the depicted embodiment the diameter of the second cylindrical portion of the plug is between one-sixteenth to one sixty-fourth greater than the diameter of the smaller cylindrical portion of the teeth. This configuration provides more clearance between the pocket and the teeth at its distal end which is adjacent to the hardfacing, and less clearance between the pocket and the teeth at its proximal end. This configuration allows the teeth to rotate during operation relative to the cutting face. The rotation results in more effective drilling and more even wear of the teeth.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A drill bit comprising:

a distal cutting end; and a proximal mounting end;

wherein the distal cutting end includes a plurality of pockets, each pocket of the plurality of pockets configured to support a cutting tooth such that the tooth is free to rotate about a longitudinal axis of the tooth and relative to the distal cutting end, wherein the distal cutting end defines a cutting face and wherein hardfacing is provided on at least seventy-five percent of the cutting face;

wherein at least some of the hardfacing is within 1/32 of an inch (0.79 millimeters) of a periphery edge of one of the plurality of pockets; and wherein each one of the plurality of pockets includes an inside surface that is free of hardfacing such that the hardfacing does not contact the tooth, the tooth being allowed to rotate without interference with the hardfacing.

2. The drill bit of claim 1, wherein the hardfacing covers at least ninety percent of the cutting face.

3. The drill bit of claim 1, further comprising at least three cutting teeth, each tooth of the at least three teeth being secured within one of the plurality of pockets such that the tooth is free to rotate relative to the distal cutting end of the drill bit.

4. The drill bit of claim 1, further comprising an angled surface that defines a leading edge at a junction between the angled surface and the distal cutting end, the angled surface extending radially outwardly towards the mounting end.

5. The drill bit of claim 4, wherein one of the plurality of pockets includes a lead pocket configured to support a cutting tooth such that the tooth extends past a plane defined by the angled surface.

6. The drill bit of claim 5, wherein a minimum distance between the leading edge of the cutting face and a periphery edge of the lead pocket is less than 0.5 inches (12.70 millimeters).

7. The drill bit of claim 4, wherein one of the plurality of pockets includes a lead pocket configured to support a cutting tooth adjacent to the angled surface, wherein a minimum distance between the leading edge of the cutting face and an edge of the lead pocket is less than 0.5 inches (12.70 millimeters).

8. The drill bit of claim 4, wherein between 15 to 25 percent of the angled surface is covered by hardfacing.

9. The drill bit of claim 4, wherein a portion of the angled surface adjacent the cutting face includes hardfacing thereon.

10. The drill bit of claim 1, wherein a maximum cross-sectional dimension of the tooth is at least 1/16 of an inch smaller than a maximum cross-sectional dimension of the pocket.

11. The drill bit of claim 1, wherein the pocket includes a front cylindrical portion and a rear cylindrical portion, wherein the tooth includes a distal cylindrical portion and a proximal cylindrical portion, wherein a diameter of the front cylindrical portion of the pocket is at least 1/32 inches greater than a diameter of the distal cylindrical portion, and wherein a diameter of the rear cylindrical portion is less than 1/32 greater than a diameter of the proximal cylindrical portion.

12. The drill bit of claim 1, wherein the hardfacing is provided on substantially the entire cutting face.

13. A drill bit comprising: a distal cutting end; and a proximal mounting end;

a plurality of pockets on the distal cutting end, wherein each pocket of the plurality of pockets includes a front cylindrical portion and a rear cylindrical portion and wherein the front cylindrical portion has a larger diameter than the rear cylindrical portion;

a plurality of teeth supported on the distal cutting end, each tooth of the plurality of teeth includes a front cylindrical portion and a rear cylindrical portion and wherein the front cylindrical portion has a larger diameter than the rear cylindrical portion;

wherein each tooth of the plurality of teeth is supported in a respective one of the plurality of pockets such that the rear cylindrical portion of the tooth is received in the rear cylindrical portion of the pocket and at least a portion of the front cylindrical portion of the tooth is received in the front cylindrical portion of the pocket;

wherein a diameter of the front cylindrical portion of the tooth is at least 1/32 smaller than the diameter of the front cylindrical portion of the pocket and wherein the diameter of the rear cylindrical portion of the tooth is less than 1/32 smaller than the diameter of the rear cylindrical portion of the pocket;

wherein the tooth is configured to be free to passively rotate in the pocket during drilling operations; and wherein the distal cutting end includes hardfacing and at least some of the hardfacing is within 1/32 of an inch (0.79 millimeters) of a periphery edge of one of the plurality of pockets; and wherein each one of the plurality of pockets includes an inside surface that is free of hardfacing such that the hardfacing does not contact the tooth, the tooth being allowed to rotate without interference with the hardfacing.

14. The drill bit of claim 13, further comprising an angled surface that defines a leading edge at a junction between the angled surface and the distal cutting end, the angled surface extending radially outwardly towards the mounting end, wherein one of the plurality of pockets includes a lead pocket configured to support a cutting tooth such that the tooth extends past a plane defined by the angled surface.

15. The drill bit of claim 14, wherein a minimum distance between the leading edge of the cutting face and a periphery edge of the lead pocket is less than 0.5 inches (12.70 millimeters).

16. A drill bit comprising:

a distal cutting end; and a proximal mounting end;

a plurality of pockets on the distal cutting end, wherein each pocket of the plurality of pockets includes a front cylindrical portion and a rear cylindrical portion and wherein the front cylindrical portion has a larger diameter than the rear cylindrical portion;

a plurality of teeth supported on the distal cutting end, each tooth of the plurality of teeth includes a front cylindrical portion and a rear cylindrical portion and wherein the front cylindrical portion has a larger diameter than the rear cylindrical portion, and each tooth of the plurality of teeth being supported in a respective one of the plurality of pockets such that the rear cylindrical portion of the tooth is received in the rear cylindrical portion of the pocket, and at least a portion of the front cylindrical portion of the tooth is received in the front cylindrical portion of the pocket;

an angled surface that defines a leading edge at a junction between the angled surface and the distal cutting end, the angled surface extending radially outwardly towards the mounting end;

wherein the tooth is configured to be free to passively rotate in the pocket during drilling operations;

wherein the distal cutting end includes hardfacing, and the hardfacing defines a circle that surrounds at least one of the plurality of pockets, the circle having a diameter that is spaced no more than 1/32 of an inch (0.79 millimeters) from a periphery edge of the pocket such that the hardfacing does not contact the tooth; and wherein the hardfacing wraps around from the cutting face to the angled face to cover an upper portion of the angled face without covering the entire angled face.

* * * * *